US009604831B2

(12) United States Patent
Bogert

(10) Patent No.: US 9,604,831 B2
(45) Date of Patent: Mar. 28, 2017

(54) PORTABLE LIFTING JACK STABILIZER APPARATUS AND METHOD

(71) Applicant: Richard W. Bogert, Kennewick, WA (US)

(72) Inventor: Richard W. Bogert, Kennewick, WA (US)

( * ) Notice: Subject to any disclaimer, the term of this patent is extended or adjusted under 35 U.S.C. 154(b) by 498 days.

(21) Appl. No.: 13/948,066

(22) Filed: Jul. 22, 2013

(65) Prior Publication Data

US 2014/0158957 A1 Jun. 12, 2014

Related U.S. Application Data

(60) Provisional application No. 61/675,735, filed on Jul. 25, 2012.

(51) Int. Cl.

| | |
|---|---|
| ***B66F 3/00*** | (2006.01) |
| ***B66F 13/00*** | (2006.01) |
| ***B66F 1/06*** | (2006.01) |

(52) U.S. Cl.

CPC ..... *B66F 13/00* (2013.01); *B66F 1/06* (2013.01)

(58) Field of Classification Search

USPC ..... 254/2 B, 8 B, 133 R, 134

See application file for complete search history.

(56) References Cited

U.S. PATENT DOCUMENTS

| | | | | |
|---|---|---|---|---|
| 4,379,546 | A | 4/1983 | McIntosh | |
| D440,022 | S | 4/2001 | Simpson et al. | |
| 6,416,039 | B1 * | 7/2002 | Pietrusynski | B66F 5/04 254/2 B |
| D506,589 | S | 6/2005 | Harrah | |
| 7,188,842 | B2 * | 3/2007 | Thorpe | B60S 9/06 280/6.153 |
| D602,836 | S | 10/2009 | Simpson et al. | |
| 7,789,426 | B2 * | 9/2010 | Hanscom | B60P 3/36 280/763.1 |

* cited by examiner

*Primary Examiner* — Joseph J Hail
*Assistant Examiner* — Shantese McDonald
(74) *Attorney, Agent, or Firm* — Seed Intellectual Property Law Group LLP

(57) ABSTRACT

A stabilizer apparatus operable with a jack device that includes a jack device base and a vertical member is provided. The stabilizer apparatus includes a stabilization base, which has a surface area greater than the surface area of the jack device base. The stabilizer apparatus stabilization base also includes a receiver section that is configured to removably receive the base of the jack device and couple the jack device to the stabilizer apparatus. The stabilizer apparatus further includes a stabilizing system configured to counteract a side load applied to a lifting end of the jack device while the jack device supports a load during a lifting operation. Related methods and systems are also provided.

19 Claims, 11 Drawing Sheets

Baseline configuration B

Elevated configuration E

PORTABLE LIFTING JACK STABILIZER APPARATUS AND METHOD

BACKGROUND

Technical Field

The present disclosure is directed to lifting devices, and more particularly, to portable lifting devices suitable for lifting vehicles and other heavy loads.

Description of the Related Art

Portable lifting devices, such as car jacks, can suffer from stability drawbacks. Such lifting devices are generally designed to lift various types of vehicles or loads in different environments and terrains. As the terrains and loads vary, the heights to which the loads are required to be lifted may vary as well. One particular conventional lifting device 10 shown in FIG. 1, patented under U.S. Pat. No. 4,379,546, includes a nose or lift member 14 that protrudes outward from the lifting device 10 and is adapted to rest against a frame or bumper of a vehicle, a jack base 12, and a vertical member 16, often referred to as a "standard." As the lift member 14, where the lifting force is applied, moves vertically along the standard 16, the eccentric load application can shift the lifting device 10 forward or to one side, thereby shifting its center of gravity. If the center of gravity approaches a tip over point, the lifting device 10 becomes unstable and susceptible to tip over under even the slightest side load.

Stability problems can be further exacerbated where the surface upon which the device sits is soft, such as on sand or mud, or on uneven surfaces. Conventional lifting devices are typically designed to rest on a flat, firm surface. Accordingly, when lifting on an uneven or soft surface, conventional lifting devices can become particularly unstable, further making some conventional jack devices susceptible to side loads and other loads that may overturn the lifting device during use.

BRIEF SUMMARY

The stabilizer apparatuses and methods described herein provide for lifting vehicles and other loads in a portable and stable manner. Some conventional jack devices tend to have narrow jack bases and become unstable as vehicles or loads are lifted above certain heights, which can result in the jack devices tipping over, and unseating the lifted vehicle or load. Embodiments of the stabilizer apparatuses described herein are particularly well-suited to operate with certain conventional jacks and stabilize the same.

According to one embodiment, a stabilizer apparatus can be summarized as including: a stabilization base having a base surface area greater than a surface area of the jack base of the jack device to distribute the load of the jack device during a lifting operation, and the stabilization base having a receiver section configured to removably receive the jack base of the jack device and couple the jack device to the stabilizer apparatus during the lifting operation; and a stabilizing system, the stabilizing system including: a first stabilizer member having a first end and a second end, the first end of the first stabilizer member coupleable to the stabilization base at a first location; a second stabilizer member having a first end and a second end, the first end of the second stabilizer member coupleable to the stabilization base at a second location; and an attachment member coupleable to the vertical member of the jack device, the second end of the first stabilizer member and the second end of the second stabilizer member each coupleable to the attachment member, and wherein the stabilizing system is configured to counteract a side load applied to the jack device while the jack device supports the load during the lifting operation. For example, the stabilizing system may counteract the side load by providing tension between the jack device and stabilization base to limit or resist relative movement therebetween.

According to another embodiment, a stabilizer apparatus may further include a tension adjustment apparatus having a biasing device coupleable between the attachment member and the vertical member of the jack device, the biasing device configured to apply a force to rotate the attachment member relative to the vertical member of the jack device to adjust the tension of the first and the second stabilizer members of the stabilizing system.

According to yet another embodiment, a method for stabilizing a jack device may be summarized as including: coupling the jack device to a stabilizer apparatus that includes a stabilization base and a stabilization system, the stabilization system further includes at least one stabilizer member; engaging an object to be lifted with a portion of the jack device; and lifting the object from an initial height to an elevated height such that the stabilization system transitions from an initial configuration to a subsequent configuration in which the at least one stabilizer member of the stabilization system is relatively more taut with respect to the initial configuration.

DETAILED DESCRIPTION

In the following description, certain specific details are set forth in order to provide a thorough understanding of various disclosed embodiments. However, one skilled in the relevant art will recognize that embodiments may be practiced without one or more of these specific details. In other instances, well-known structures and devices associated with lifting devices, such as, for example, conventional jacks and the like, may not be shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Figure 1:
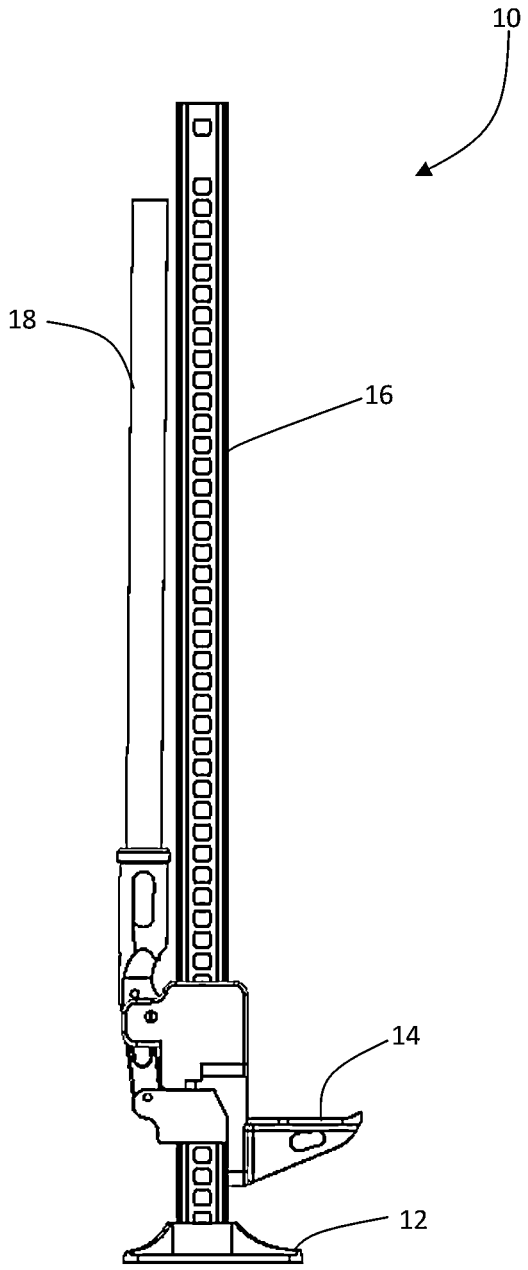
Figure 1 (Prior Art)
FIG. 1 is a side elevational view of a conventional jack device.

FIG. 1 shows a conventional jack device 10 in the form of a HI-LIFT™ jack available from The Hi-Lift Jack Company of Bloomfield, Ind. The jack device 10 includes a lifting member 14, which is designed to engage a bumper or a frame of a vehicle to lift the same. The jack device 10 further includes a vertical member 16, commonly known as a "standard", through which vertical direction advancement of the lift member 14 is achieved. The jack device 10 also includes a lever 18, which, when moved in a jacking action, moves the lifting member 14 along the vertical member 16 to thereby lift the vehicle as the lifting member 14 engages the vehicle bumper or frame. The jack device 10 rests on a jack device base 12, whose surface area distributes the load to a surface, from which the vehicle or object is lifted.

Figure 2:
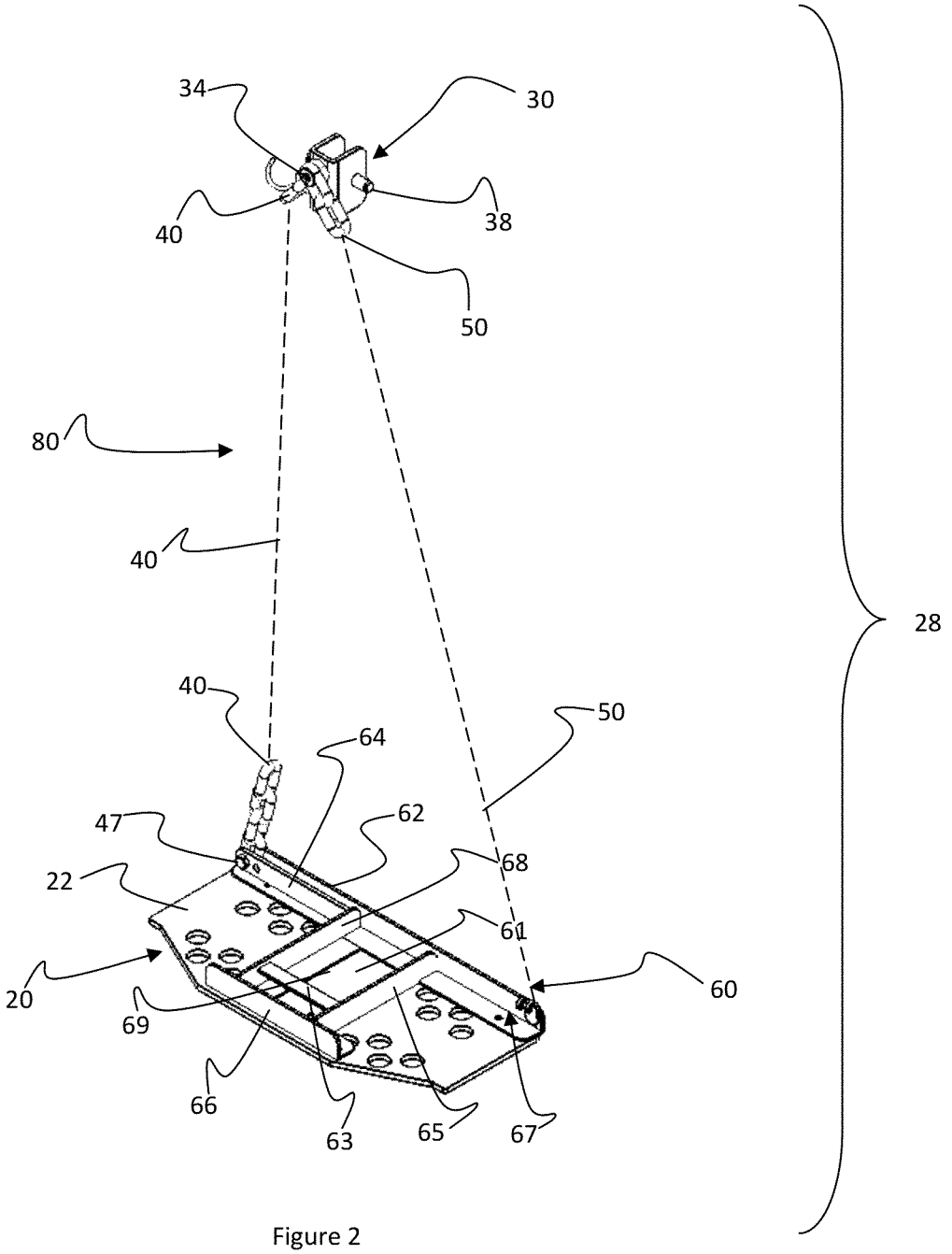
FIG. 2 is an isometric view of a stabilizer apparatus, according to one embodiment, operable with the jack device of FIG. 1.
Figure 3:
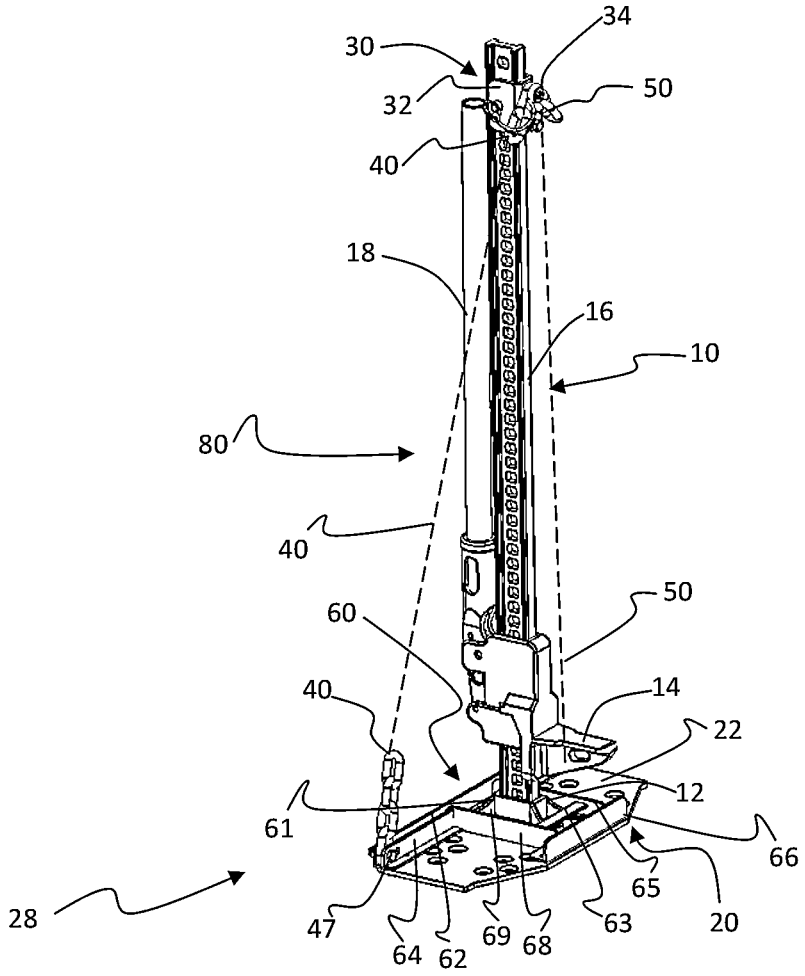
FIG. 3 is an isometric view of the stabilizer apparatus of FIG. 2, shown coupled to the jack device of FIG. 1.

FIG. 2 shows an embodiment of a stabilizer apparatus or kit 28, which is operable with the jack device 10 of FIG. 1 to provide enhanced stability. FIG. 3 shows the jack device 10 of FIG. 1 coupled to the stabilizer apparatus or kit 28 of FIG. 2. With reference to FIGS. 2 and 3, the stabilizer apparatus or kit 28 includes a stabilization system 80 and a stabilization base 20. The stabilization system 80 includes a first stabilization member 40 (partially represented by a dashed line), a second stabilization member 50 (partially represented by a dashed line), and an attachment member 30. The stabilization system 80 may function to provide a counteracting force to stabilize the jack device 10 as the stabilizer members 40,50 come under tension and limit movement of the jack device 10 relative to the stabilization base 20. The stabilization base 20, meanwhile, may function to removably receive the jack device 10 and increase the surface area to distribute a load of the jack device 10.

With continued reference to FIGS. 2 and 3, the first stabilization member 40 may be, for example, a chain. The first stabilization member 40 may be pivotably coupled to the stabilization base 20 at a first end by a fastener 47, for example. A second end of the first stabilization member 40 may be pivotably coupled to an attachment member 30 by a fastener, such as a stud 34, which is secured to the attachment member 30. The second stabilization member 50 may also be a chain. While partially shown in FIGS. 2 and 3, the first end of the second stabilization member 50 may also be pivotably coupled to the stabilization base 20 by a fastener 47 in a similar manner as the first stabilization member 40. A second end of the second stabilization member 50 may also be pivotably coupled to the attachment member 30 by the same fastener, the stud 34, which pivotably couples the second end of the first stabilization member 40, or by a different fastener. The first and second stabilization members 40, 50 in the example embodiment shown in FIGS. 2 and 3 are chains; however, in other embodiments, cables 43, 53 (FIG. 9), rigid or folding metal rods or tubes, telescoping rods or tubes, reinforced fabric or composites, among other structures, may be used. Moreover, while the example embodiment of FIGS. 2 and 3 shows pivotably coupling the second end of the first stabilization member 40 and the second end of the second stabilization member 50 to the attachment member 30 by a single fastener, such as a stud 34, other mechanisms, such as, for example, clamping or mounting through a clevis, may be used. Moreover, each stabilization member 40, 50 may be connected to the attachment member 30 at different locations.

One skilled in the relevant art will recognize that the choice of the various embodiments of the first stabilization member 40 and the second stabilization member 50 may vary according to the application and, in some cases, the weight of the object that is lifted. However, irrespective of the form, the various embodiments of the first stabilization member 40 and second stabilization member 50 function to counteract a side load that may be applied to the jack device 10 during at least a portion of the lifting operation and after an object is lifted. For example, the stabilizing members 40, 50 may counteract the side load by providing tension between the jack device 10 and stabilization base 20 to limit or resist relative movement therebetween.

Figure 4:
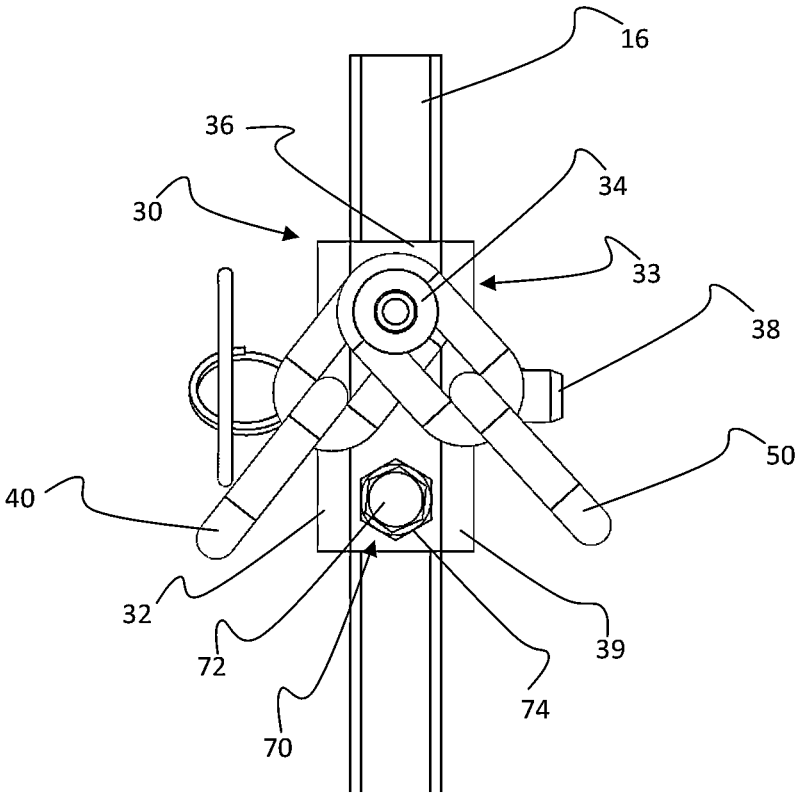
FIG. 4 is an enlarged partial front elevational view of the stabilizer apparatus of FIG. 2 shown attached to the vertical member of the jack device of FIG. 1.
Figure 5A:
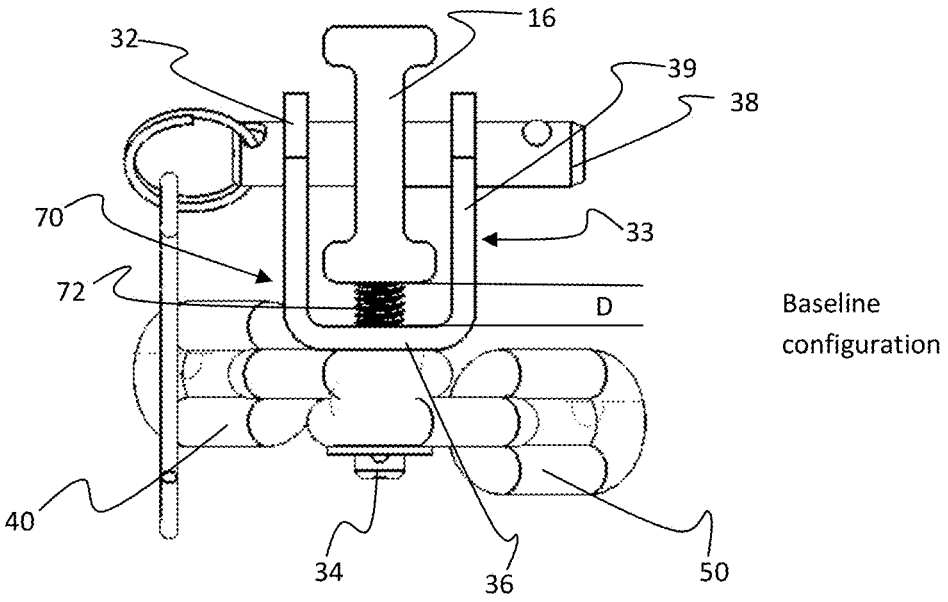
FIGS. 5*a* and 5*b* are enlarged top plan views of a portion of the stabilizer apparatus of FIG. 2 showing the stabilizer apparatus in a baseline and a rotated configuration relative to the vertical member of the jack device of FIG. 1.
Figure 5B:
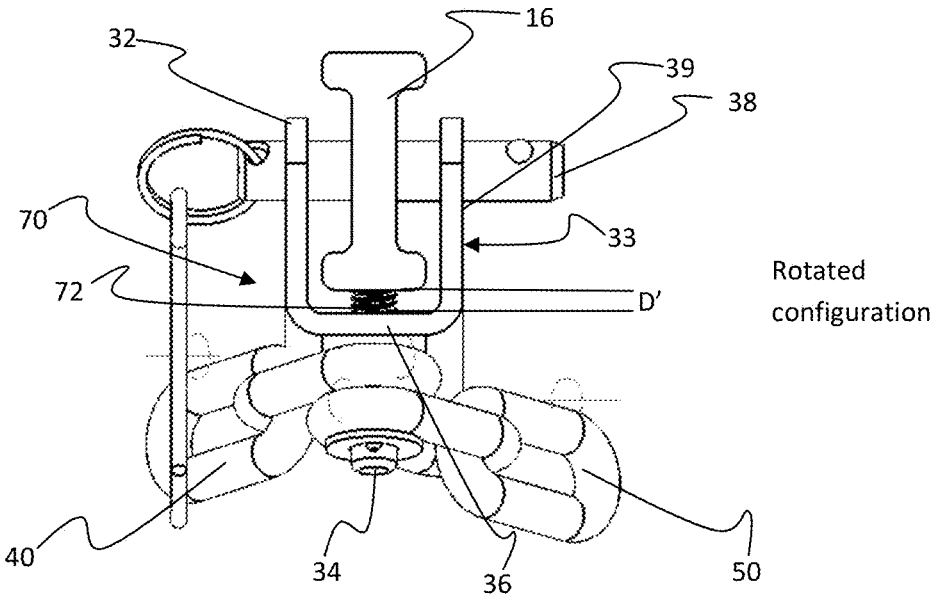

FIGS. 4, 5*a* and 5*b* show an enlarged partial view of the stabilizer apparatus of FIGS. 2 and 3. The attachment member 30 may comprise a C-shaped member 33 that partially surrounds the vertical member 16. This C-shaped member 33 may be formed by a first flange 32, a second generally parallel flange 39, and a third flange 36. The first flange 32 and the second generally parallel flange 39 may also have aligned apertures through which the attachment member 30 can be pivotably coupled to the vertical member 16 by a pin 38 or other fastener. As can be appreciated, the attachment member 30 may be manufactured using different methods, may be of a different shape, and may be coupled to the vertical member 16 in various ways.

With continued references to FIGS. 4, 5*a* and 5*b*, the stabilizer apparatus or kit 28 (FIGS. 2 and 3) may also include a tension adjusting mechanism 70. The tension adjustment mechanism 70 may include a biasing device 72 that may be coupled between the attachment member 30 and the vertical member 16. Furthermore, the biasing device 72 may be configured such that it applies a force in a manner that rotates the attachment member 30 relative to the vertical member 16. This rotation of the attachment member 30 may adjust the separation distance D in the baseline configuration between the attachment member 30 and the vertical member 16 to a different distance D' in the rotated configuration, which accordingly may adjust the tension in the first stabilizer member 40 and the second stabilizer member 50. The biasing device 72 may be a threaded fastener. The mechanism by which a force may be applied can be via the threaded fastener engaging a nut 74 rigidly coupled to the third flange 36 of the C-shaped member 33, and wherein the end of the threaded fastener abuts the vertical member 16. In other embodiments, the third flange may include a tapped hole in lieu of the nut 74 described above, whereby a threaded fastener, abutting the vertical member 16, may rotate the attachment member 30 by adjusting the separation distance D to a different distance D', as the threaded fastener engages the tapped hole.

Figure 6:
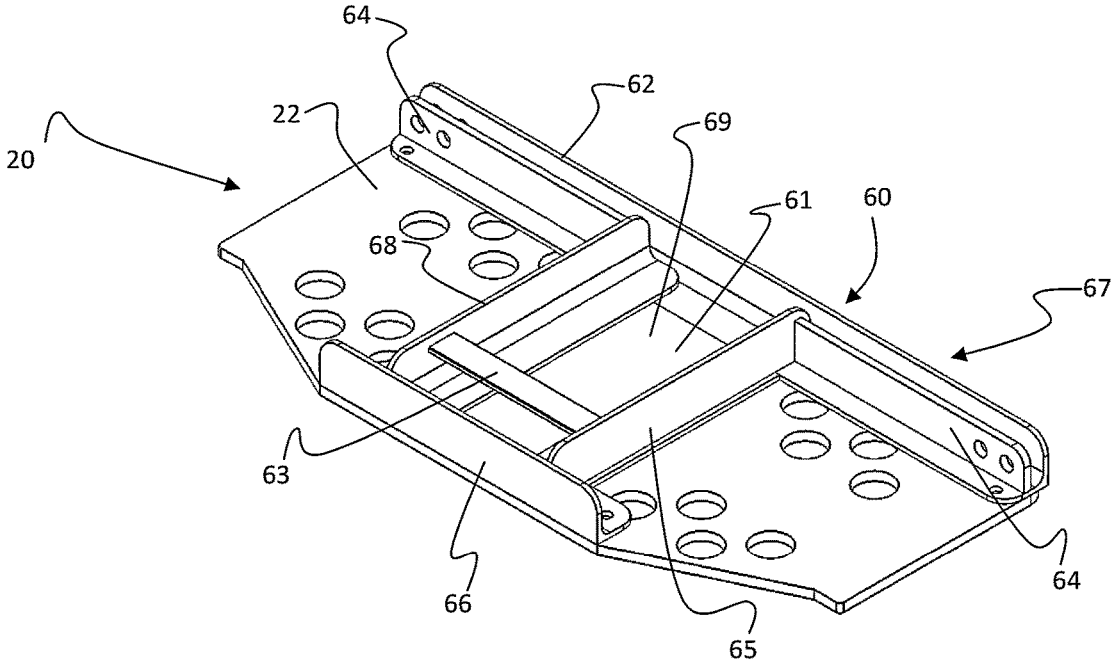
FIG. 6 is an isometric view of a stabilization base of the stabilizer apparatus of FIG. 2.

FIG. 6 shows further details of the stabilization base 20 of the stabilizer apparatus or kit 28 (FIGS. 2 and 3). The jack device 10 (FIG. 1) can be removably coupled to the stabilizer apparatus or kit 28 (FIGS. 2 and 3) via the stabilization base 20. For this purpose, the stabilization base 20 may include a stabilization base plate 22 and a receiver section 60. In some embodiments, the stabilization base plate 22 and the receiver section 60 may be two separate components, which are welded together or otherwise integrally joined to form the stabilization base 20. However, in other embodiments, the stabilization base plate 22 and the receiver section 60 may be coupled together by a variety of other attachment methods, such as, for example, bonding or fastening the stabilization base plate 22 and the receiver section 60. Moreover, the stabilization base plate 22 and the receiver section 60 may be machined as a single unit, cast-formed, injection molded, among others, as a single, integrally formed stabilization base 20. The form of the stabilization base 20 may depend on the application, strength and weight requirements of the lifting operation, and other variables. Additionally, in other embodiments, the stabilization base 20 may be provided without the base plate 22, and in some embodiments only include a receiver section 60.

With continued reference to FIG. 6, the receiver section 60 may comprise a first side member 68 and a second side member 65. Both side members 68 and 65 may be made of an L-shaped section, which can create a recess 69 for receiving the jack device base 12 therebetween. The receiver section 60 may also comprise a forward member 66 and a rearward member 67. The forward member 66 may be made of an L-shaped section. The rearward member 67 may include a first flange 62 and a second flange 64. The first flange 62 may be made of an L-shaped section and the second flange 64 may be a flat plate. The second flange 64 may be coupled to the first flange 62. The first side member 68, the second side member 65, the rearward member 67 first flange 62 and second flange 64, and the forward member 66 can all be coupled to the base plate 22 to create the recess area 69 that is sized to receive the jack device base 12 and enclose a perimeter thereof. The recess area 69 may further have a center positioning mechanism, wherein the installed jack base 12 may be repositionable to the center of the stabilization base 20. For example, an embodiment of the receiver section 60 may include side members 65, 68 having a plurality of apertures that have been tapped and configured to position and fix the jack base 12 via threaded fasteners, whereby the threaded fasteners will abut the jack base 12 to fix it in the appropriate position.

With continued reference to FIG. 6, the receiver section 60 may also include a retainer member 63. In the example embodiment, the retainer member 63 may be coupled to the first side member 68 and second side member 65 to span across a portion of the jack device base 12. When installed, the retainer member 63 may be a flat bar or other structure.

With continued reference to FIG. 6, the large surface area of the stabilization base plate 22 and, accordingly, the stabilization base 20 is also clearly visualized. This large surface area allows the narrow jack device base 12 to further distribute the load of a lifted object, thus stabilizing the jack device 10. In some embodiments, the surface area of the jack device base 12 is effectively increased by at least two times via coupling to the stabilizer apparatus or kit 28. A plurality of the apertures in the stabilization base plate 22 further allows reduction in weight and stiffness. The number and arrangement of the apertures may depend on the desired application. The plurality of the apertures may, in addition to reduction in weight and stiffness, also further stabilize the jack devices 10 when used on relatively soft surfaces, such as, for example, sand. The apertures may work, for example, to grip the ground and prevent the stabilization base 20 from sliding in any direction.

Figure 7:
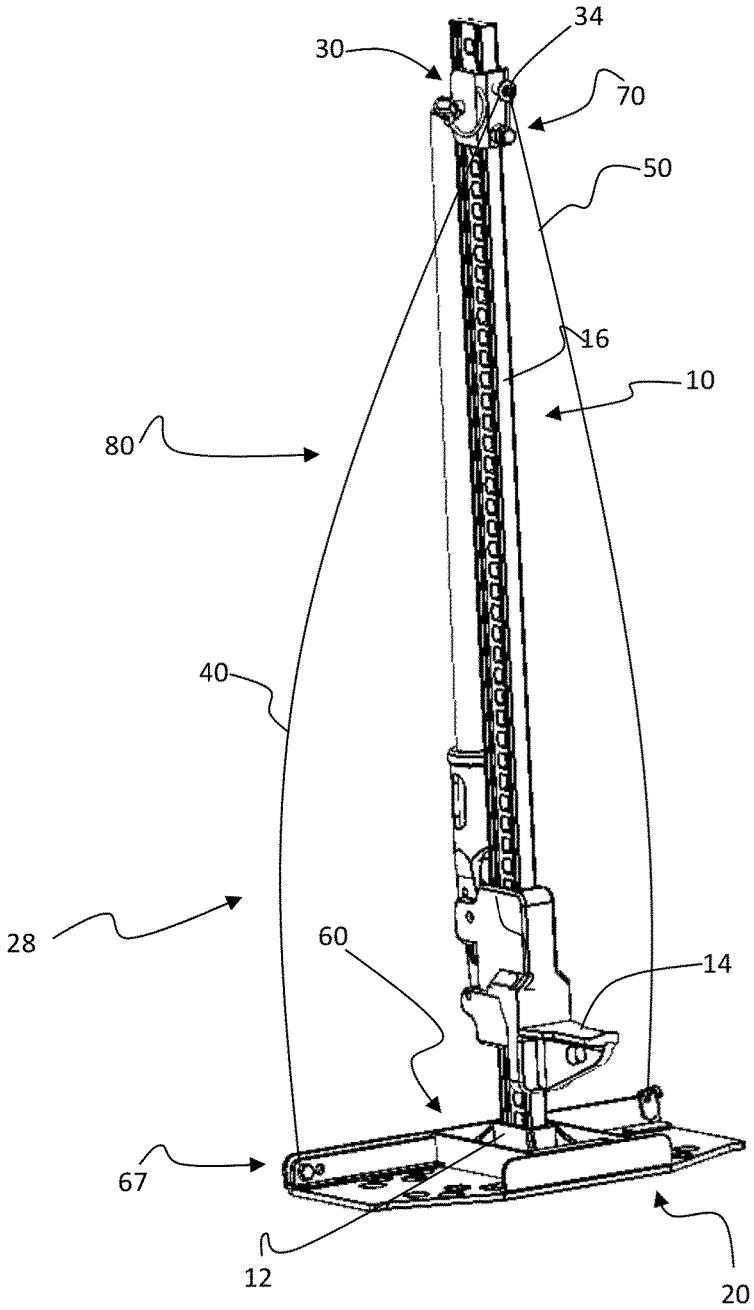
FIG. 7 is an isometric view of a stabilizer apparatus of FIG. 2 shown with the jack device in a baseline configuration.
Figure 8:
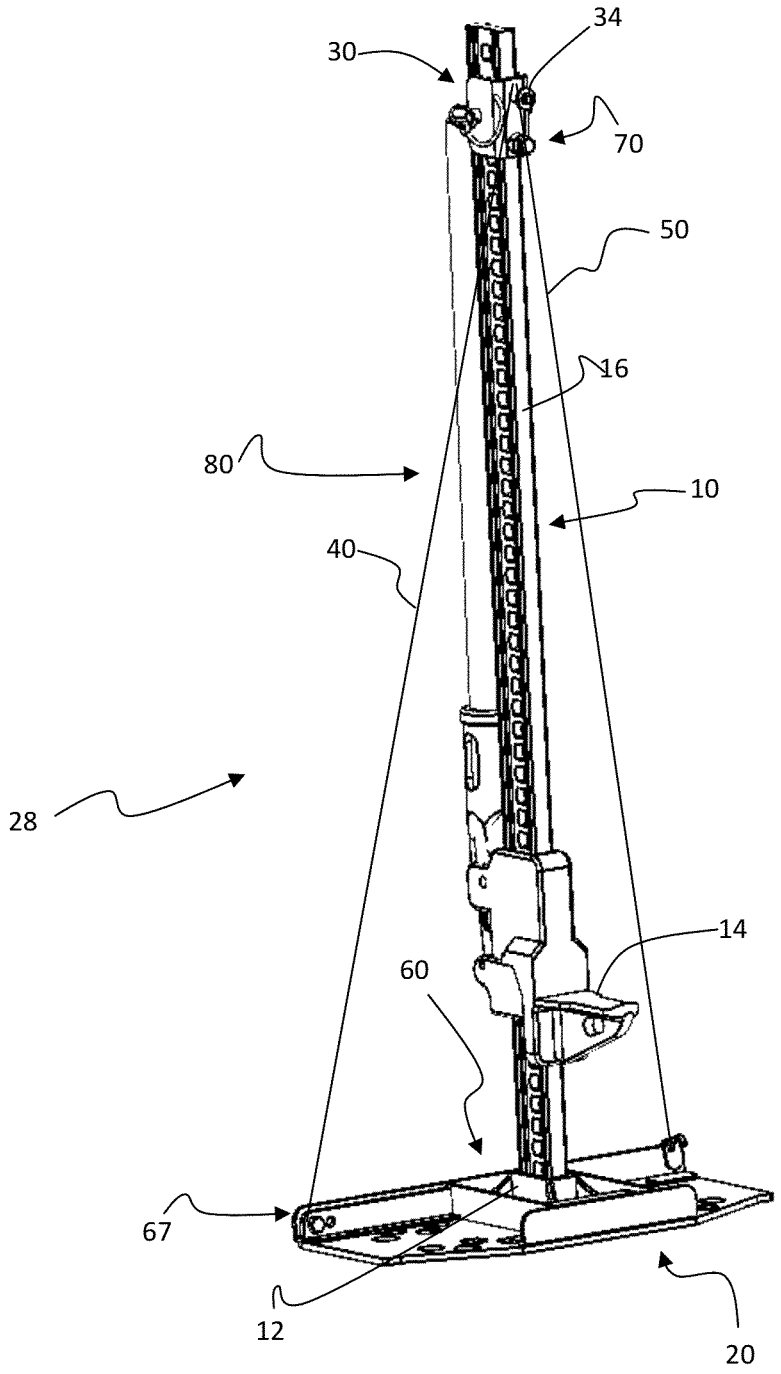
FIG. 8 is an isometric view of a stabilizer apparatus of FIG. 7, shown with the jack device in an elevated configuration.

FIG. 7 shows the stabilizer apparatus or kit 28 (FIGS. 2 and 3) wherein the jack device 10 is in a baseline or relaxed configuration B. FIG. 8 shows the stabilizer apparatus or kit 28 (FIGS. 2 and 3) wherein the jack device is in an elevated configuration E, reached upon lifting an object or a load. One skilled in the relevant art will recognize that the counteracting or stabilizing force to a side load is achieved through a tension force in the first stabilizer member 40 and the second stabilizer member 50. The first stabilizer member 40 and the second stabilizer member 50 in the baseline configuration B may be loosely connected to the stabilization base 20 and the attachment member 30. However, in the elevated configuration E, the first stabilizer member 40 and the second stabilizer member 50 may be relatively taut between the stabilization base 20 and the attachment member 30 to provide a stabilizing tension force generated by the lifting operation. In the elevated configuration E, the stabilization system 80 and stabilization base 20 may form a triangular arrangement in which the upper end of the vertical member 16 is tethered to respective corner regions of the stabilization base 20 by the first stabilizer member 40 and the second stabilizer member 50. An apex of the triangular arrangement is provided at the location where the first stabilization member 40 and the second stabilization member 50 are coupled to the attachment member 30.

With continued references to FIGS. 7 and 8, the triangular arrangement may include the first stabilizer member 40 and the second stabilizer member 50 forming the legs of the triangle, and with a portion of the stabilization base 20 forming a base of the triangle, such as, for example, the rearward member 67. This triangular arrangement, moreover, may keep the first stabilizer member 40 and the second stabilizer member 50 in a relatively taut position in the elevated configuration E. Furthermore, in instances where the first stabilization member 40 and the second stabilization member 50 are unable to generate sufficient tension, such as due to longer lengths of the aforementioned stabilization members 40, 50, for example, the tension adjustment mechanism 70 may be used to advantageously provide selective adjustment of tension in the stabilization members 40, 50.

Figure 9:
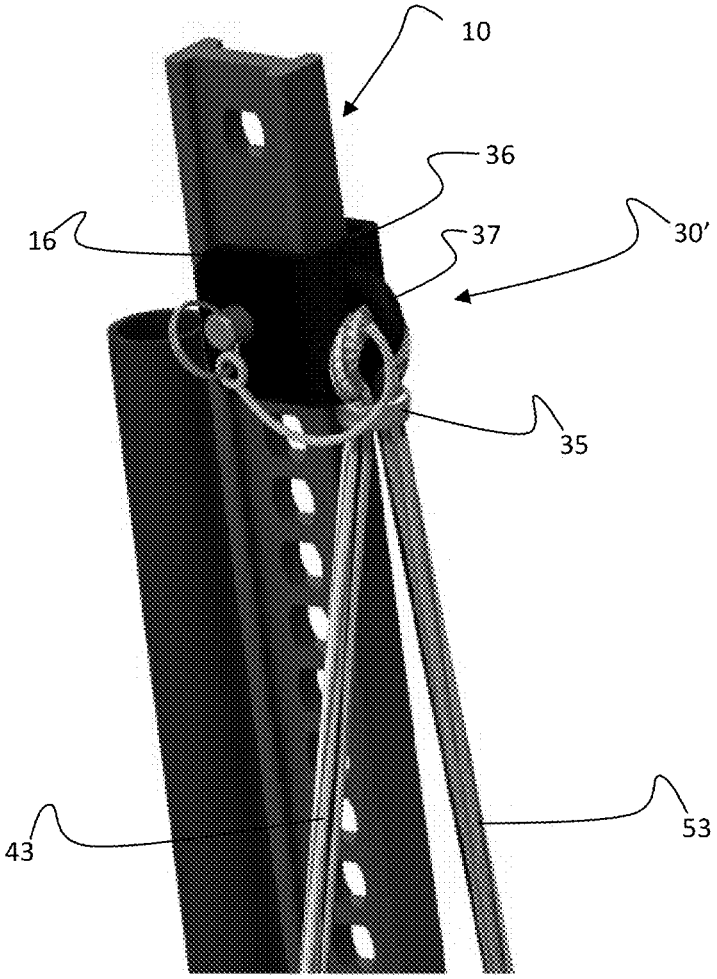
FIG. 9 is a partial perspective view of a stabilizer apparatus, according to another embodiment.

FIG. 9 shows a partial perspective view of a stabilizer apparatus or kit 28 according to one embodiment. In this example embodiment, the first stabilizer member 43 and the second stabilizer member 53 are cables. In addition, the third flange 36 of the attachment member 30' includes a further lug 37, which may be used to couple the first stabilizer member 43 and the second stabilizer member 53 to the attachment member 30' via a clamp 35 or other fastener.

Figure 10:
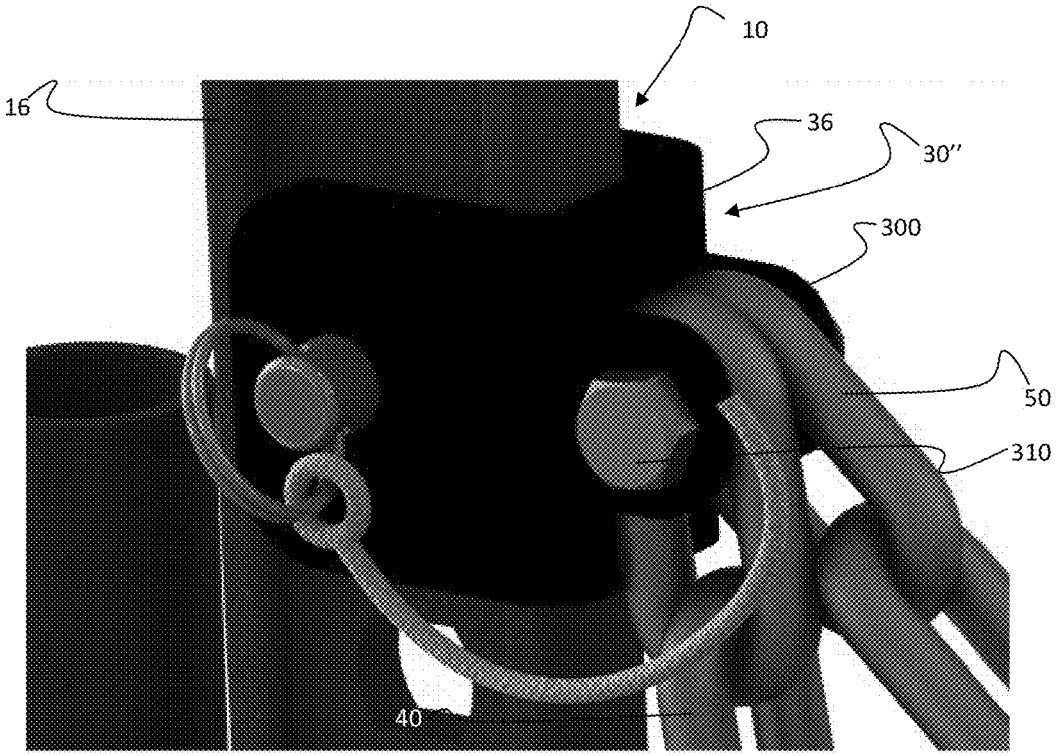
FIG. 10 is a partial perspective view of a stabilizer apparatus, according to another embodiment.

FIG. 10 shows a partial perspective view of a stabilizer apparatus or kit 28 according to another embodiment. In this example embodiment, the attachment member 30" includes a further clevis 300, which may be used to couple the first stabilizer member 40 and the second stabilizer member 50 to the attachment member 30" via a fastener 310 or other pin.

Figure 11:
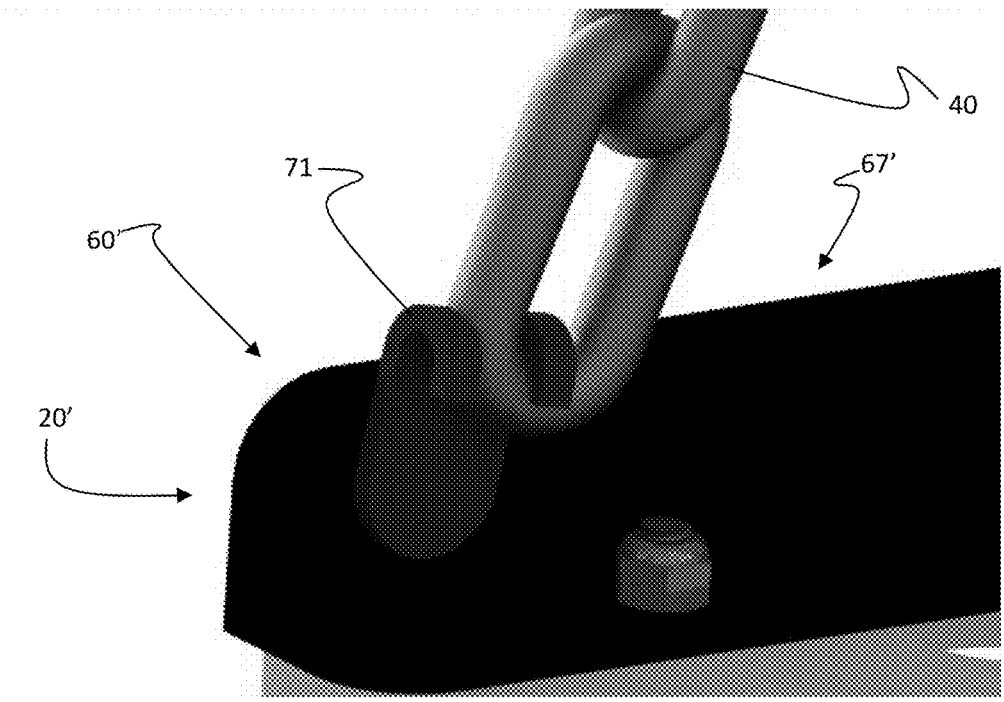
FIG. 11 is a partial perspective view of a stabilizer apparatus, according to another embodiment.

FIG. 11 shows a partial perspective view of a stabilizer apparatus or kit 28 according to another embodiment. In this example embodiment, the first stabilizer member 40 may be coupled to the stabilization base 20' via an attachment hook 71 that may be coupled to the rearward member 67' of the receiver section 60'. Moreover, a similar arrangement may be used to couple the second stabilization member 50 to the stabilization base 20'.

Figure 12:
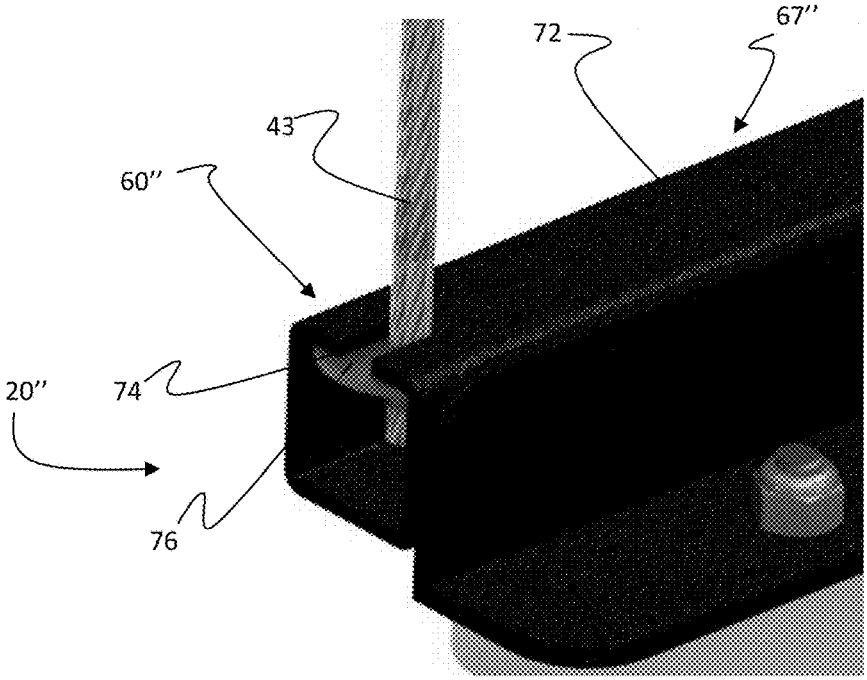
FIG. 12 is a partial perspective view of a stabilizer apparatus, according to another embodiment.

FIG. 12 shows a partial perspective view of a stabilizer apparatus or kit 28 according to yet another embodiment. In this example embodiment, the rearward member 67" of the receiver section 60" may include a hollow square shaped element 72, which may have a slot 74 at each distal end of the rearward member 67". The first stabilization member 43 may couple to the stabilization base 20" via a fork attachment connector 76 that may be coupled to the rearward member 67" through the slot 74. Moreover, a similar arrangement may be used to couple the second stabilization member 53 to the stabilization base 20".

In accordance with the various embodiments of the stabilizer apparatuses 28 described herein, a related method may be provided which includes coupling a jack device 10 to a stabilizer apparatus or kit 28 that includes a stabilization base 20 and a stabilization system 80. The stabilization system may further include at least one stabilizer member. The method may further include engaging an object to be lifted with a portion of the jack device, and lifting the object from an initial height to an elevated height such that the stabilization system 80 transitions from an initial configuration to a subsequent configuration in which the at least one stabilizer member of the stabilization system 80 is relatively more taut with respect to the initial configuration. In some embodiments, the method may further increase the tension in the at least one stabilizer member via a tension adjustment mechanism 70. Some applications may require more or less tension force in the stabilization system 80, and thus having the tension adjustment feature 70 will enable users to adjust the system as needed or desired.

Although the embodiments of the stabilizer apparatus or kit 28 shown in the figures include a stabilization system 80 that has a pair of stabilizer members 40, 50, in other embodiments the stabilization system 80 may have only a single stabilizer member or more than two stabilizer members. For example, three stabilizer members may be provided to tether the end of the upper end of the vertical member 16 to the stabilization base 20 in a tripod arrangement.

Moreover, aspects and features of the various embodiments described above can be combined to provide further embodiments. In addition, U.S. Provisional Patent Application No. 61/675,735, filed Jul. 25, 2012, is incorporated by reference for all purposes and aspects of the invention can be modified, if necessary, to employ features, systems, and concepts disclosed in the application to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A stabilizer apparatus operable with a jack device that includes a jack base, a lift member and a vertical member along which the lift member is adapted to move to lift a load, the stabilizer apparatus comprising:

a stabilization base having a base surface area greater than a surface area of the jack base of the jack device to distribute the load of the jack device during a lifting operation, and the stabilization base having a receiver section configured to removably receive the jack base of the jack device and couple the jack device to the stabilizer apparatus during the lifting operation, wherein the receiver section includes a first side member and a second side member, the first side member and the second side member arranged to create a recess to receive the jack base of the jack device; and a stabilizing system, the stabilizing system including:

a first stabilizer member having a first end and a second end, the first end of the first stabilizer member coupleable to the stabilization base at a first location;

a second stabilizer member having a first end and a second end, the first end of the second stabilizer member coupleable to the stabilization base at a second location; and an attachment member coupleable to the vertical member of the jack device, the second end of the first stabilizer member and the second end of the second stabilizer member each coupleable to the attachment member, wherein the stabilizing system is configured to counteract a side load applied to the jack device while the jack device supports the load during the lifting operation.

2. The stabilizer apparatus of claim 1 wherein the receiver section further includes a retainer member, the retainer member coupled to the first side member and the second side member to restrict upward movement of the jack device when the jack base of the jack device is received in the receiver section.

3. The stabilizer apparatus of claim 2 wherein the receiver section further includes a forward member and a rearward member, each of the forward member and the rearward member coupled to the first side member and the second side member to enclose an outer perimeter of the jack base of the jack device when the jack base of the jack device is received in the receiver section.

4. The stabilizer apparatus of claim 3 wherein the rearward member includes a first flange and a generally parallel second flange, the first flange and the generally parallel second flange having generally aligned apertures to form a clevis.

5. The stabilizer apparatus of claim 4 wherein each of the first end of the first stabilizer member and the first end of the second stabilizer member is coupleable to the rearward member via a respective fastener.

6. The stabilizer apparatus of claim 1 wherein the stabilization base of the stabilizer apparatus has a plurality of apertures arranged to reduce the weight of the stabilization base, and wherein the plurality of apertures further stabilize the stabilizer apparatus when on a relatively soft surface.

7. The stabilizer apparatus of claim 1, further comprising:

an anti-slip plate rigidly coupled to the stabilization base of the stabilizer apparatus.

8. The stabilizer apparatus of claim 1 wherein the receiver section of the stabilization base is coupled to the stabilization base of the stabilizer apparatus via fasteners.

9. The stabilizer apparatus of claim 1 wherein the receiver section of the stabilization base is welded to the stabilization base.

10. The stabilizer apparatus of claim 1 wherein the stabilization base is a single, integrally formed unit.

11. A jack assembly comprising the stabilizer apparatus of claim 1 and the jack device.

12. A stabilizer apparatus operable with a jack device that includes a jack base, a lift member and a vertical member along which the lift member is adapted to move to lift a load, the stabilizer apparatus comprising:

a stabilization base having a base surface area greater than a surface area of the jack base of the jack device to distribute the load of the jack device during a lifting operation, and the stabilization base having a receiver section configured to removably receive the jack base of the jack device and couple the jack device to the stabilizer apparatus during the lifting operation;

a stabilizing system, the stabilizing system including:

a first stabilizer member having a first end and a second end, the first end of the first stabilizer member coupleable to the stabilization base at a first location;

a second stabilizer member having a first end and a second end, the first end of the second stabilizer member coupleable to the stabilization base at a second location; and an attachment member coupleable to the vertical member of the jack device, the second end of the first stabilizer member and the second end of the second stabilizer member each coupleable to the attachment member, wherein the stabilizing system is configured to counteract a side load applied to the jack device while the jack device supports the load during the lifting operation; and a center positioning mechanism, and wherein, when the jack device is installed in the stabilizer apparatus, the jack base of the jack device is repositionable to a center of the stabilization base of the stabilizer apparatus by the center positioning mechanism.

13. A stabilizer apparatus operable with a jack device that includes a jack base, a lift member and a vertical member along which the lift member is adapted to move to lift a load, the stabilizer apparatus comprising:

a stabilization base having a base surface area greater than a surface area of the jack base of the jack device to distribute the load of the jack device during a lifting operation, and the stabilization base having a receiver section configured to removably receive the jack base of the jack device and couple the jack device to the stabilizer apparatus during the lifting operation; and a stabilizing system, the stabilizing system including:

a first stabilizer member having a first end and a second end, the first end of the first stabilizer member coupleable to the stabilization base at a first location;

a second stabilizer member having a first end and a second end, the first end of the second stabilizer member coupleable to the stabilization base at a second location; and an attachment member coupleable to the vertical member of the jack device, the second end of the first stabilizer member and the second end of the second stabilizer member each coupleable to the attachment member, wherein the stabilizing system is configured to counteract a side load applied to the jack device while the jack device supports the load during the lifting operation and, wherein, the stabilizing system further includes a tension adjustment apparatus having a biasing device coupleable between the attachment member and the vertical member of the jack device, the biasing device configured to apply a force to rotate the attachment member relative to the vertical member of the jack device to adjust the tension of the first and the second stabilizer members of the stabilizing system.

14. The stabilizer apparatus of claim 13 wherein the biasing device of the tension adjustment apparatus includes a threaded fastener configured to apply a force to the vertical member of the jack device by engaging the attachment member.

15. A stabilizer apparatus operable with a jack device that includes a jack base, a lift member and a vertical member along which the lift member is adapted to move to lift a load, the stabilizer apparatus comprising:

a stabilization base having a base surface area greater than a surface area of the jack base of the jack device to distribute the load of the jack device during a lifting operation, and the stabilization base having a receiver section configured to removably receive the jack base of the jack device and couple the jack device to the stabilizer apparatus during the lifting operation; and a stabilizing system, the stabilizing system including:

a first stabilizer member having a first end and a second end, the first end of the first stabilizer member coupleable to the stabilization base at a first location;

a second stabilizer member having a first end and a second end, the first end of the second stabilizer member coupleable to the stabilization base at a second location; and an attachment member coupleable to the vertical member of the jack device, the second end of the first stabilizer member and the second end of the second stabilizer member each coupleable to the attachment member, wherein the stabilizing system is configured to counteract a side load applied to the jack device while the jack device supports the load during the lifting operation, wherein the attachment member includes a first flange, a second flange, and a third flange that are configured such that the first flange is generally parallel to the second flange and the third flange connects the first flange and the second flange to form a C-shaped member, and wherein the C-shaped member includes aligned apertures in the first flange and the second flange such that the attachment member is pivotably coupleable to the vertical member of the jack device via the aligned apertures and wherein the third flange includes a mechanism to pivotably couple the second end of the first stabilizer member and the second end of the second stabilizer member together.

16. A method for stabilizing a jack device having a jack base, a lift member and a vertical member, the method comprising:

coupling the jack device to a stabilizer apparatus that includes a stabilization base and a stabilization system, the stabilization system including at least one stabilizer member;

engaging an object to be lifted with a portion of the jack device;

lifting the object from an initial height to an elevated height such that the stabilization system transitions from an initial configuration to a subsequent configuration in which the at least one stabilizer member of the stabilization system is relatively more taut with respect to the initial configuration; and adjusting the tension in the at least one stabilization member of the stabilization system prior to engaging the object to be lifted.

17. The method of claim 16 wherein coupling the jack device to the stabilizer apparatus includes positioning the jack base of the jack device to a center of the stabilizer apparatus.

18. A system for lifting an object, the system comprising:

a jack device having a jack base and a vertical member configured to vertically advance the object to be lifted;

a stabilization base removably coupled to the jack device, the stabilization base having a base surface area greater than a surface area of the jack base of the jack device to distribute a load of the jack device during a lifting operation; and a stabilizing system, the stabilizing system including:

a first stabilizer member having a first end and a second end, the first end of the first stabilizer member coupled to the stabilization base at a first location;

a second stabilizer member having a first end and a second end, the first end of the second stabilizer member coupled to the stabilization base at a second location; and an attachment member pivotably coupled to the vertical member of the jack device, the second end of the first stabilizer member and the second end of the second stabilizer member each coupled to the attachment member, and wherein the stabilizing system is configured to counteract a side load applied to the jack device while the jack device supports the object during the lifting operation.

19. The system of claim 18 wherein the stabilizing system further includes a tension adjustment apparatus having a biasing device coupled between the attachment member and the vertical member of the jack device, the biasing device configured to apply a force to rotate the attachment member relative to the vertical member of the jack device to adjust tension of the first and the second stabilizer members of the stabilizing system.

* * * * *